US005105230A

United States Patent [19]

Emori

[11] Patent Number: 5,105,230

[45] Date of Patent: Apr. 14, 1992

[54] IMAGE FORMING APPARATUS CAPABLE OF SELECTIVELY FEEDING A SHEET LONGITUDINALLY OR LATERALLY

[75] Inventor: Kiyoshi Emori, Osaka, Japan

[73] Assignee: Minolta Camera Kabushiki Kaisha, Osaka, Japan

[21] Appl. No.: 575,495

[22] Filed: Aug. 30, 1990

[30] Foreign Application Priority Data

Aug. 31, 1989 [JP] Japan ..... 1-226430
Jun. 15, 1990 [JP] Japan ..... 2-157877

[51] Int. Cl.[5] ..... G03G 21/00
[52] U.S. Cl. ..... 355/319; 355/308
[58] Field of Search ..... 355/319, 321, 308, 309, 355/311

[56] References Cited

U.S. PATENT DOCUMENTS 4,305,655 12/1981 Gamblin et al. ..... 355/319 X
4,591,884 5/1986 Miyamoto et al. ..... 355/319 X
4,727,402 2/1988 Smith ..... 355/319
4,845,525 7/1989 Ito ..... 355/319 X
4,851,883 7/1989 Ito ..... 355/55
4,876,562 10/1989 Suzuki et al. ..... 346/160
5,003,493 3/1991 Okada et al. ..... 355/311 X
5,031,116 7/1991 Shukunami et al. ..... 355/311 X

FOREIGN PATENT DOCUMENTS 89051 5/1986 Japan .

*Primary Examiner*—A. T. Grimley
*Assistant Examiner*—Nestor R. Ramirez
*Attorney, Agent, or Firm*—Willian Brinks Olds Hofer Gilson & Lione

[57] ABSTRACT

A pair of sheet accommodating sections separately accommodate sheets of the same size in different directions, i.e., in lateral and longitudinal directions; and the sections are selectively used so as to feed a sheet which corresponds to the placement of images to be formed on both sides of a sheet. An image forming member is controlled so as to have a longitudinal image formed on a sheet parallel to or perpendicular to the sheet transporting direction.

13 Claims, 17 Drawing Sheets

IMAGE FORMING APPARATUS CAPABLE OF SELECTIVELY FEEDING A SHEET LONGITUDINALLY OR LATERALLY

BACKGROUND OF THE INVENTION

1. Field of the Invention

The present invention relates to an image forming apparatus for forming an image by printing which corresponds to a sheet feeding direction, and more particularly, to an image forming apparatus which is capable of forming images on both sides of a sheet.

2. Description of Related Art

In recent years, a printing controller for use in a printer is arranged to perform printing operation by selecting various rotational angels of 0°, 90°, 180°, 270° of font data so that printing can be performed for any direction on a sheet transported in a fixed direction. Moreover, by combining sequential control of printing output, an image can be formed in any print layout on the sheet. Accordingly, it can freely comply with such requirement as performing printing on both sides of a sheet, or forming an image in any print layout, or forming an image which is bound in various methods. Further, the sheet feed direction can be freely selected either for lateral or longitudinal direction.

However, depending on the direction or placement of images to be printed on both sides of a sheet and depending on the method how the sheets are bound, printing has to be performed from the reverse direction corresponding with the sheet feed direction which is selected, and printing data has to be output in reverse order. In order to perform said operation, more complicated printing mechanism and control system have to be arranged, and eventually it requires expensive manufacturing cost.

SUMMARY OF THE INVENTION

A main object of the present invention is to provide a simple and inexpensive image forming apparatus which is capable of corresponding to various directions or placements of images to be formed when printing is made on both sides of a sheet with further capability of corresponding to the method of binding the sheet on which images have already been formed. In order to accomplish said object, there are provided an image forming means capable of forming images on both sides of a sheet and sheet accommodating sections for feeding sheets of the same size to the image forming means either laterally or longitudinally by selectively using a sheet accommodating section which corresponds to the direction or placement of the images formed on both sides of the sheet and the direction the sheets are bound.

With such a constructional arrangement of the present invention, when images are formed on both sides of a sheet by the image forming means, it can correspond with the direction or placement of images and the binding direction of the sheet on which images are formed by making outputting order of the rotational angle of font data, direction of drawing and printing data in the same sequence since either one of the sheet accommodating sections is selectively used for feeding the sheets of same size laterally or longitudinally corresponding to the direction or placement of images to be formed and the binding direction of the sheets.

Another object of the present invention is to provide an image forming apparatus which can instantly correspond with the state where a sheet is not accommodated in a selected sheet accommodating section. In order to accomplish said object, the present invention is arranged to give a warning when sheet is not accommodated in a selected sheet accommodating section. With such a constructional arrangement, an operator can immediately cope with the state where sheet is not accommodated in a selected sheet accommodating section since a warning is given to the operator.

These and other objects and features of the present invention will become more apparent from the following description taken in conjunction with the preferred embodiments thereof with reference to the accompanying drawings.

DESCRIPTION OF THE PREFERRED EMBODIMENT

An embodiment of the present invention will now be described referring to the accompanying drawings.

Figure 1:
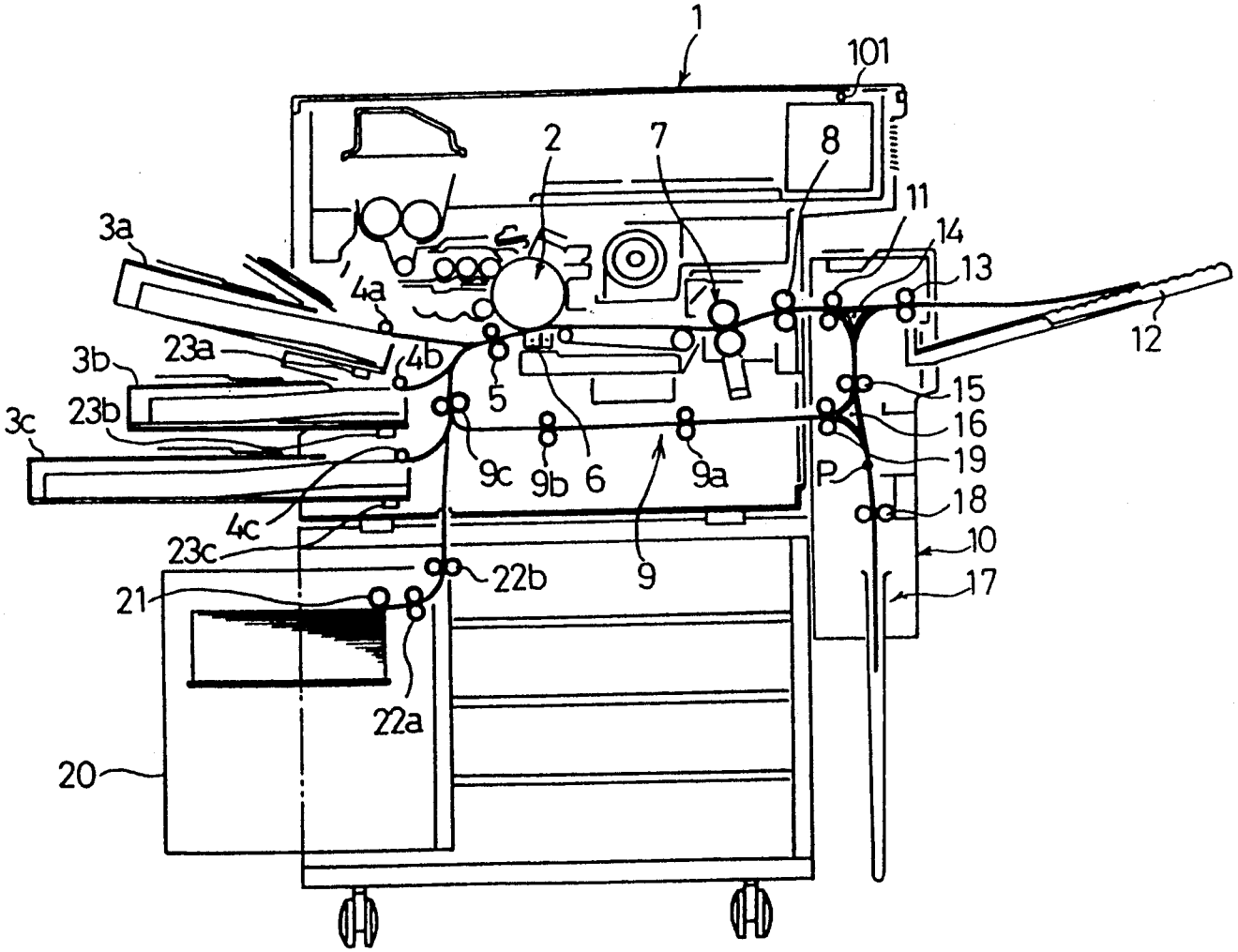
FIG. 1 is a schematic constructional view of an image forming apparatus showing an embodiment of the present invention.

FIG. 1 shows an electrophotographic image forming apparatus to which the present invention is applied. In the FIG. 1, reference numeral 1 represents a main body of the image forming apparatus. Substantially at the central portion of the main body, there is arranged a well-known electrophotographic image forming section 2 which is provided with a charger, exposure optical system, developing unit, transfer charger, drum cleaner and the like. Reference numerals 3*a*, 3*b* and 3*c* represent a plurality of paper feed cassettes mounted on one side of the main body 1. Paper feed rollers 4*a*, 4*b* and 4*c* are provided corresponding to the paper feed cassettes 3*a*, 3*b* and 3*c*. One of the paper feed rollers 4*a*, 4*b*, 4*c* selected is operated to send out a sheet from the paper feed cassette which corresponds to the paper feed roller, and the sheet is fed toward a timing roller 5. The timing roller 5 forwards the sheet toward the transfer section 6 positioned between the photoconductive drum and transfer charger in the image forming section 2 after making timing adjustment for the sheet fed thereto. The sheet onto which an image is transferred at the transfer section 6 is fixed at the fixing section 7 and is then sent out to a duplex unit 10 by a discharge roller 8.

At the lower portion of the main body 1, there is arranged a paper re-feed path 9. The paper re-feed path 9 is arranged for re-feeding the sheet sent out from the duplex unit 10 toward the timing roller 5. The paper re-feed path 9 is provided with transport rollers 9*a*, 9*b* and 9*c* for transporting the sheet.

In the duplex unit 10, there are provided a first changeover claw 14 and a second changeover claw 16 for properly changing the transporting direction of a sheet. The first changeover claw 14 is positioned between a carry-in roller 11 provided for receiving a sheet discharged from the duplex unit 10 and a discharge roller 13 provided for discharging the sheet onto a discharge tray 12, and is arranged to selectively send out a sheet either toward the discharge tray 12 or toward the second changeover claw 16 through a transport roller 15 which is rotatable reversely.

The second changeover claw 16 is arranged to selectively send in a sheet toward a switchback section 17 or send out a sheet toward the paper re-feed path 9 through a delivery roller 19 or send out a sheet in the switchback section 17 toward the paper re-feed path 9 or send out a sheet toward the paper discharge tray 12 through the transport roller 15 and first changeover claw 14. Reference numeral 18 represents a transport roller in the switchback section which is reversely rotatable, and a mark P represents a point where the sheet is reversed.

Reference numeral 20 represents an optional paper feed section, 21 a paper feed roller, and 22*a* and 22*b* transport rollers respectively. The optional paper feed section 20 is an elevator type stacker for accommodating and feeding a large number of sheets. Numerals 23*a*, 23*b* and 23*c* represent well-known sheet size detecting means and they are disposed under the paper feed cassettes 3*a*, 3*b* and 3*c*. The sheet size detecting means consists of a plurality of microswitch and the like to detect the size of sheet and also the paper feed direction whether it is set for lateral feed or longitudinal feed (for instance, the Japanese Published Patent Publication TOKKAI SHO No. 63-70865).

Figure 2A:
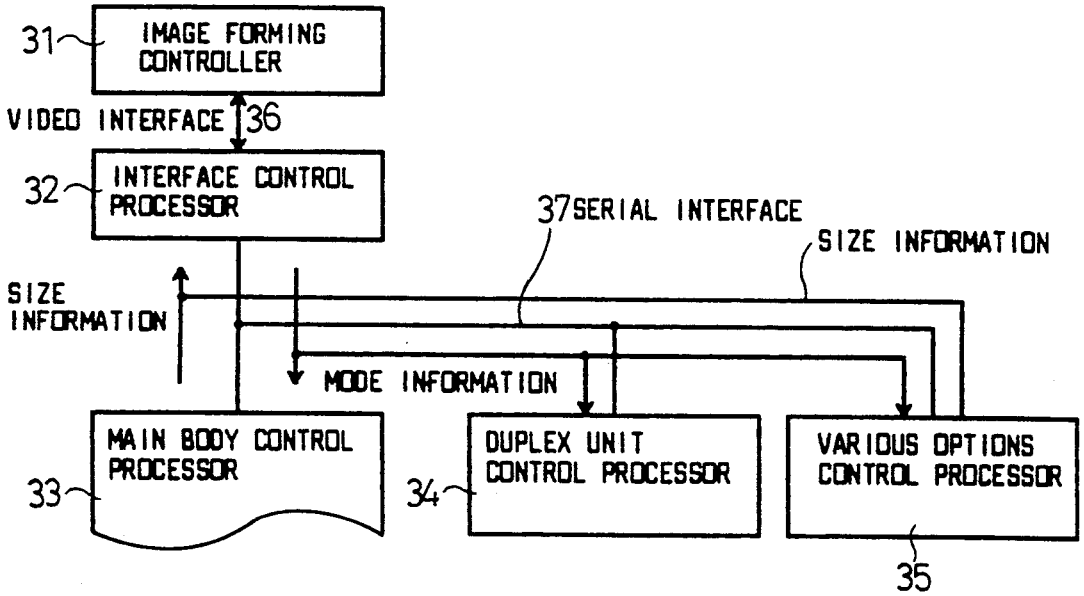
FIG. 2*a* is a block diagram schematically showing a control device of the image forming apparatus.
Figure 2B:
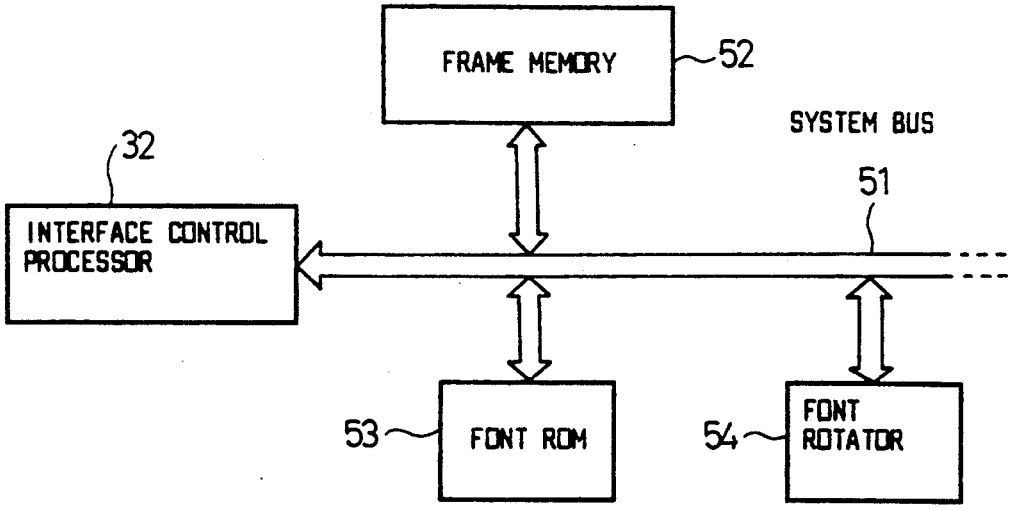
FIG. 2*b* is a block diagram schematically showing a font control section which is connected to an interface control processor of the control device.

The FIG. 2*a* shows a whole structure of a control device. In the FIG. 2*a*, reference numeral 31 represents an image forming controller, 32 an interface control processor, 33 a main body control processor, 34 a duplex unit control processor, and 35 a control processor for various optional operations respectively.

The image forming controller 31 performs a mode selection of paper feed and designates the mode to the interface control processor 32 through a video interface 36. In accordance with said designation, the interface control processor 32 sets the mode for the main body control processor 33, duplex unit control processor 34 and option control processor 35 through a serial interface 37.

The main body control processor 33 and various option control processor 35 transmit information of sheet size and the like detected by the sheet size detecting means 23*a*, 23*b* and 23*c* to the image forming controller 31 through the interface control processor 32.

A system bus 51 is connected to the interface control processor 32 as illustrated in the FIG. 2*a*. To the system bus 51, frame memory 52, font ROM 53 and font rotator 54 are connected. The frame memory 52 is a memory provided for storing image data of one page by dot image. Corresponding to character code, the font ROM 53 outputs the character dot image. In the present invention, there are provided two kinds of font of 0° and 90°. The font rotator 54 rotates the dot image output from the font ROM 53 90° or 180°. The system bus 51 transmits control data and dot image between the processor, memory and the like connected thereto.

Description will now be made on the case when the images are formed on both sides of a sheet, wherein the images are formed in various directions or placements and in various binding directions as illustrated in the FIGS. 3 through 7.

Referring to the FIG. 1, in the case when one side printing is selected, a sheet fed from one of the paper feed cassettes 3*a*, 3*b* and 3*c* receives an image transfer process at the transfer section 6 after making timing adjustment by the timing roller 5. Then, the sheet is guided to the transport roller 13 side by the first changeover claw 14 through the discharge roller 8 and the carry-in roller 11 to be discharged onto the paper discharge tray 12.

While, in the case when both sides printing is selected, the sheet which has received a first round of transfer process is guided to the second changeover claw 16 side by the first changeover claw 14 after it has passed through the discharge roller 8 and carry-in roller 11 with an image formed on a first side, and is then sent into the switchback section 17 through the transport rollers 15 and 18. When the rear end of the sheet has reached the reversing point P, the transport roller 18 is reversely rotated and the sheet is switched back.

The sheet switched back is guided to the send-out roller 19 side by the second changeover claw 16 and is then sent out to the paper re-feed path 9 by the send-out roller 19. The sheet is thereafter forwarded to the timing roller 5 by the transport rollers 9*a*, 9*b* and 9*c* through the paper re-feed path 9 to receive another transfer process on the second side of the sheet at the transfer section 6 after making timing adjustment. The sheet on the second side of which an image is formed is now guided to the side of the delivery roller 13 when it has reached the first changeover claw 14 passing through the fixing section 7, discharge roller 8 and the carry-in roller 11 to be discharged onto the paper discharge tray 12.

Description will now be made on the relationship of images formed by printing on both sides of the fist side and second side of the sheet.

Figure 3:
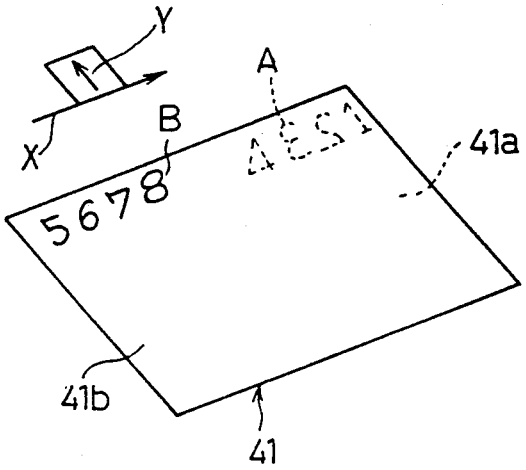
FIG. 3 is a perspective view showing an example of a sheet whose both sides are printed.

As illustrated in the FIG. 3, when printing direction of both the first and second side of the sheet is in the direction of Y relative to the paper feed direction X for forming lateral images A and B on the first side 41*a* and 41*b* of a sheet 41, the images A and B look upward in the direction of Y as shown in the figure.

Now, take the cases into consideration when images are formed for various methods of binding as illustrated in the FIGS. 4 through 7.

Figure 4:
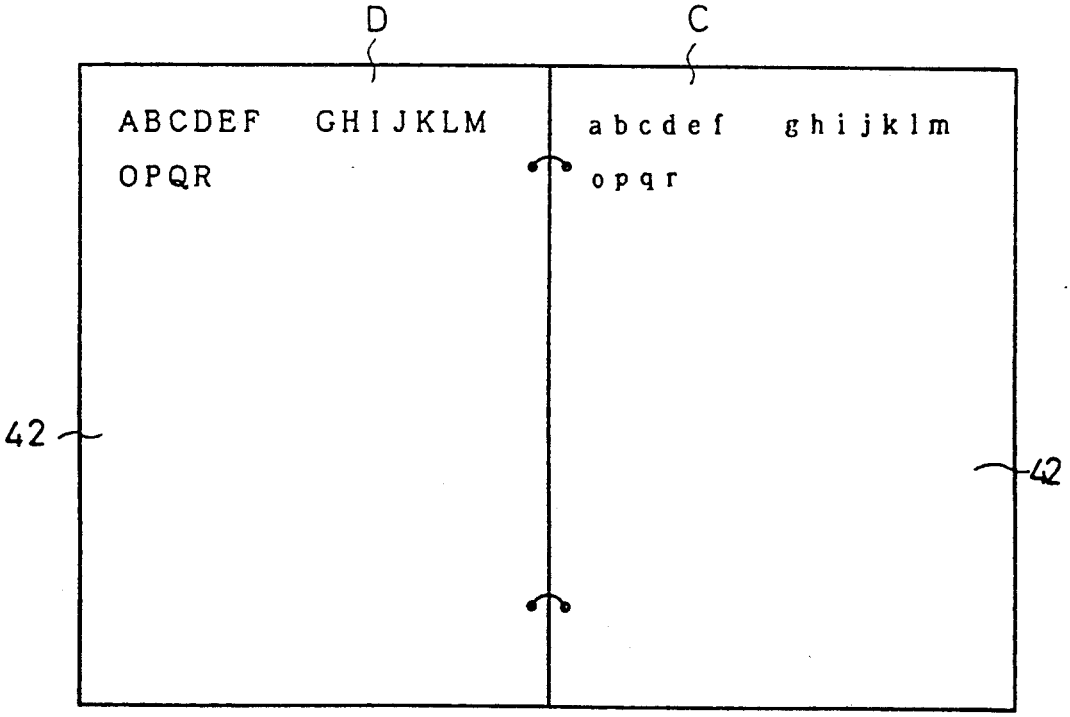
FIGS. 4 through 7 are front views of sheets whose both sides are printed showing examples of combinations of the direction or placement of images and binding direction.

The FIG. 4 shows a case when a sheet 42 is bound longitudinally on which longitudinal images C and D are formed.

Figure 5:
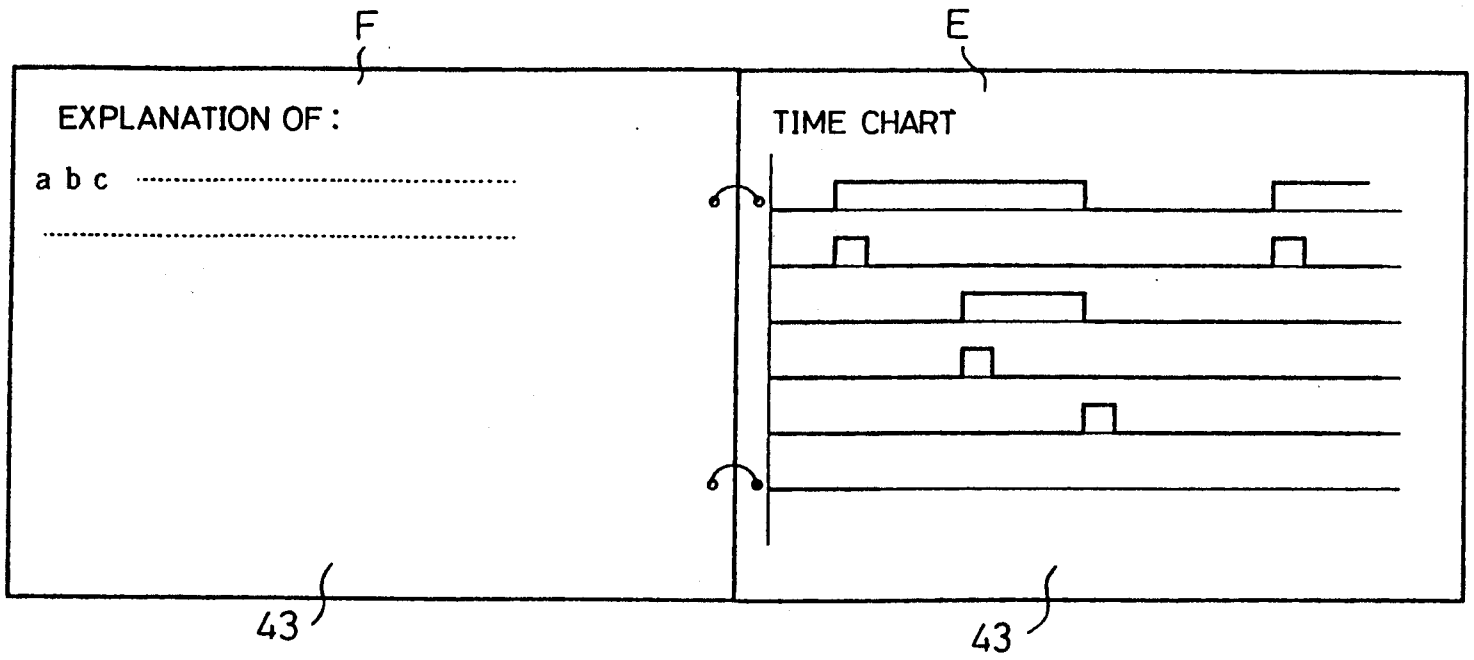

The FIG. 5 shows a case when a sheet 43 is bound laterally on which lateral images E and F are formed.

Figure 6:
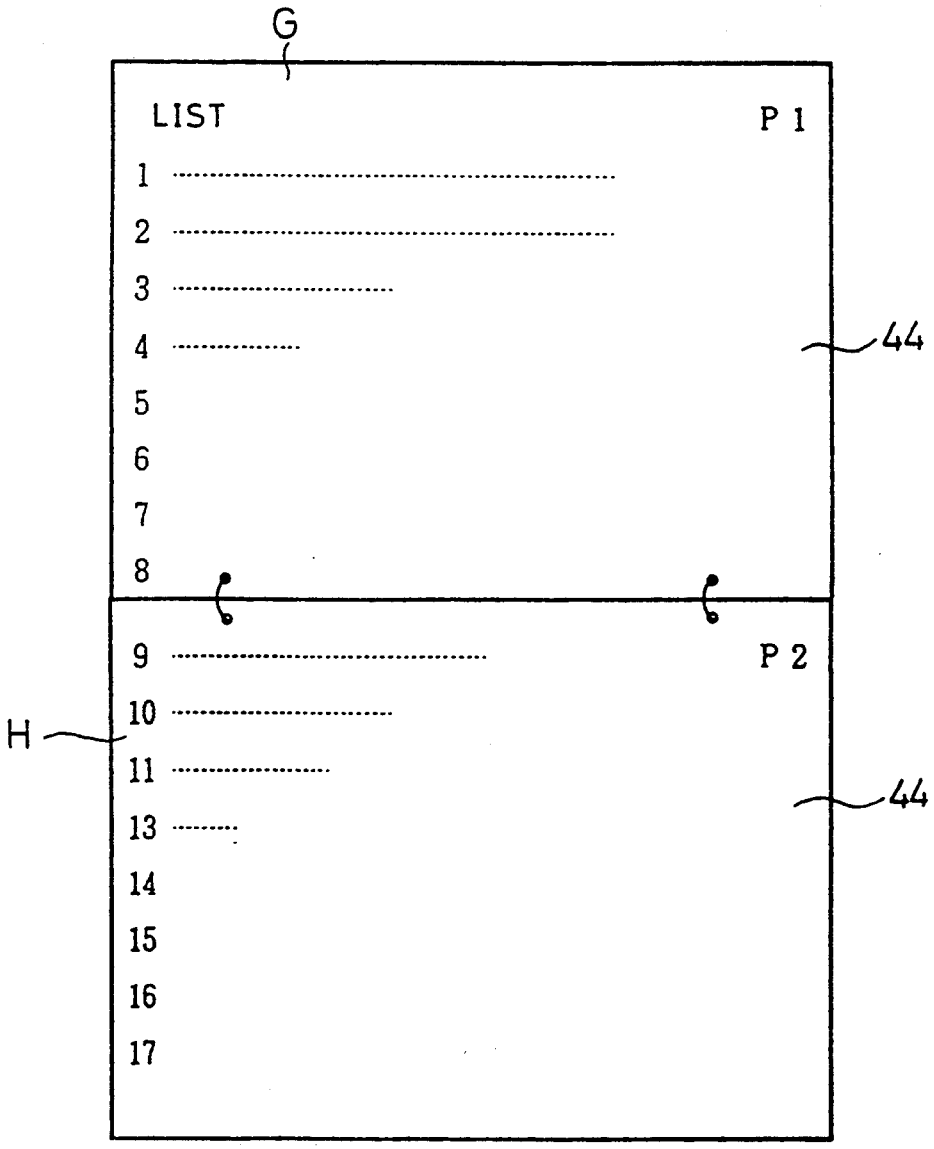

The FIG. 6 shows a case when a sheet 44 is bound longitudinally on which lateral images G and H are formed.

Figure 7:
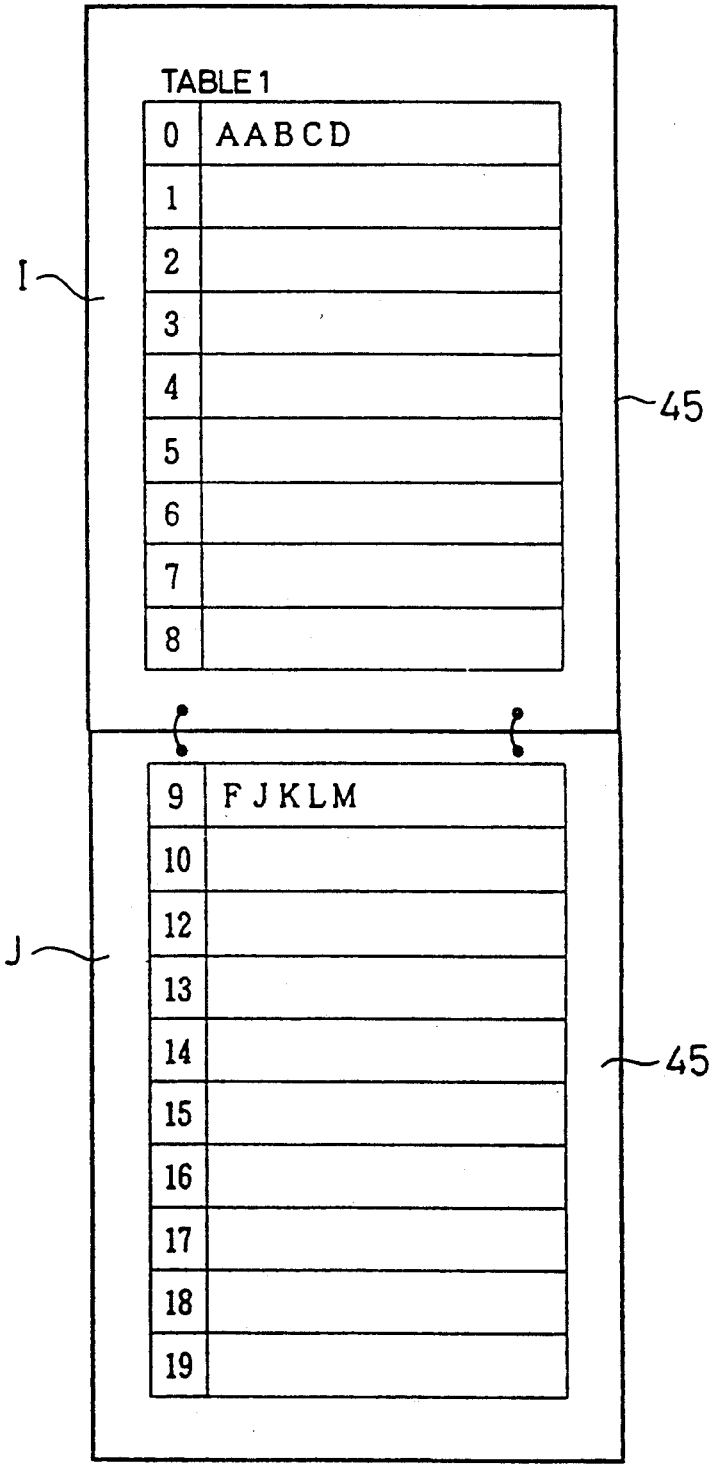

The FIG. 7 shows a case when a sheet 45 is bound laterally on which longitudinal images I and J are formed.

Figure 8:
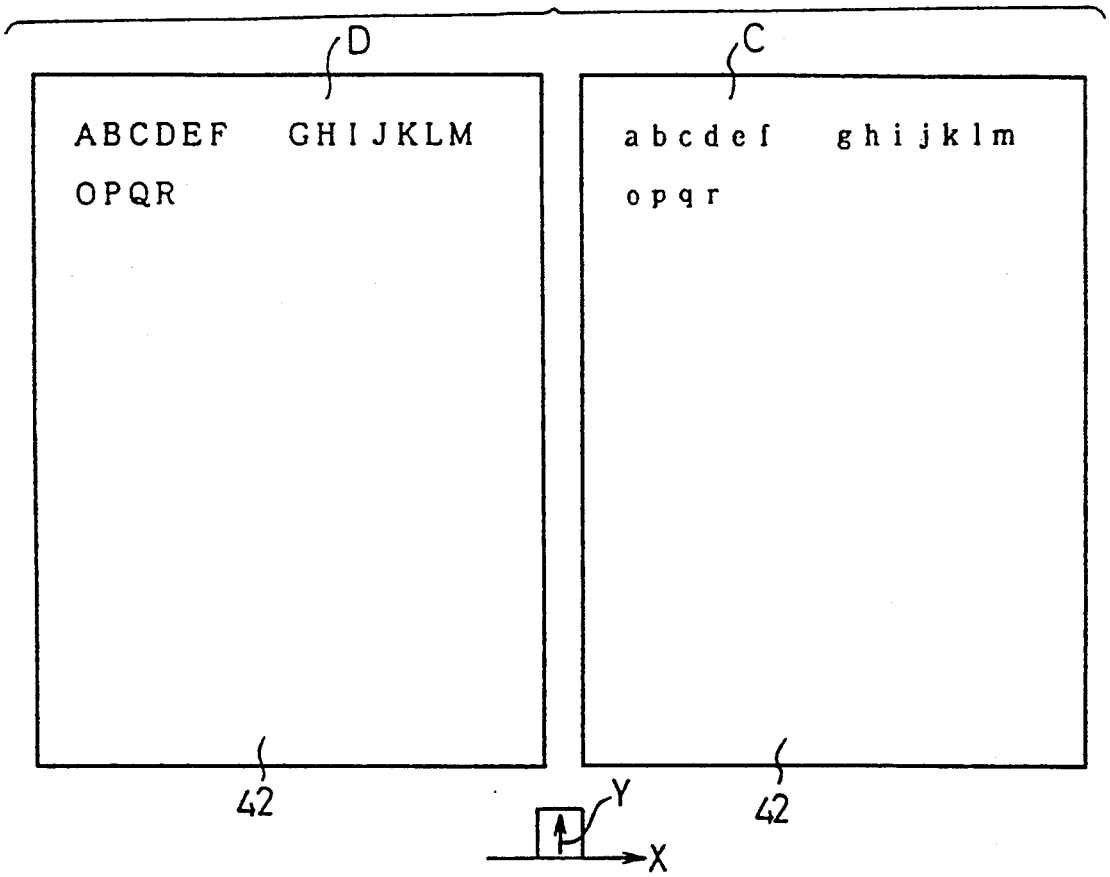
FIGS. 8 through 11 are front views showing examples of combinations of rotational angle of font data and sheet feed direction when both sides of a sheet are printed as illustrated in the FIGS. 4 through 7.

In the case of the images C and D shown in the FIG. 4, when a sheet 42 is laterally fed and both sides printing is performed with the printing direction Y as shown in the FIG. 3, the image D can be formed on the surface of the next sheet 42 as shown in the FIG. 8 assuming that the image C is formed on the reverse side of the preceding sheet 42 as shown in the FIG. 8. Accordingly, even if the sheets 42, 42 are bound laterally as shown in the FIG. 4, the images C and D stand side by side in the same direction when they are spread.

Figure 9:
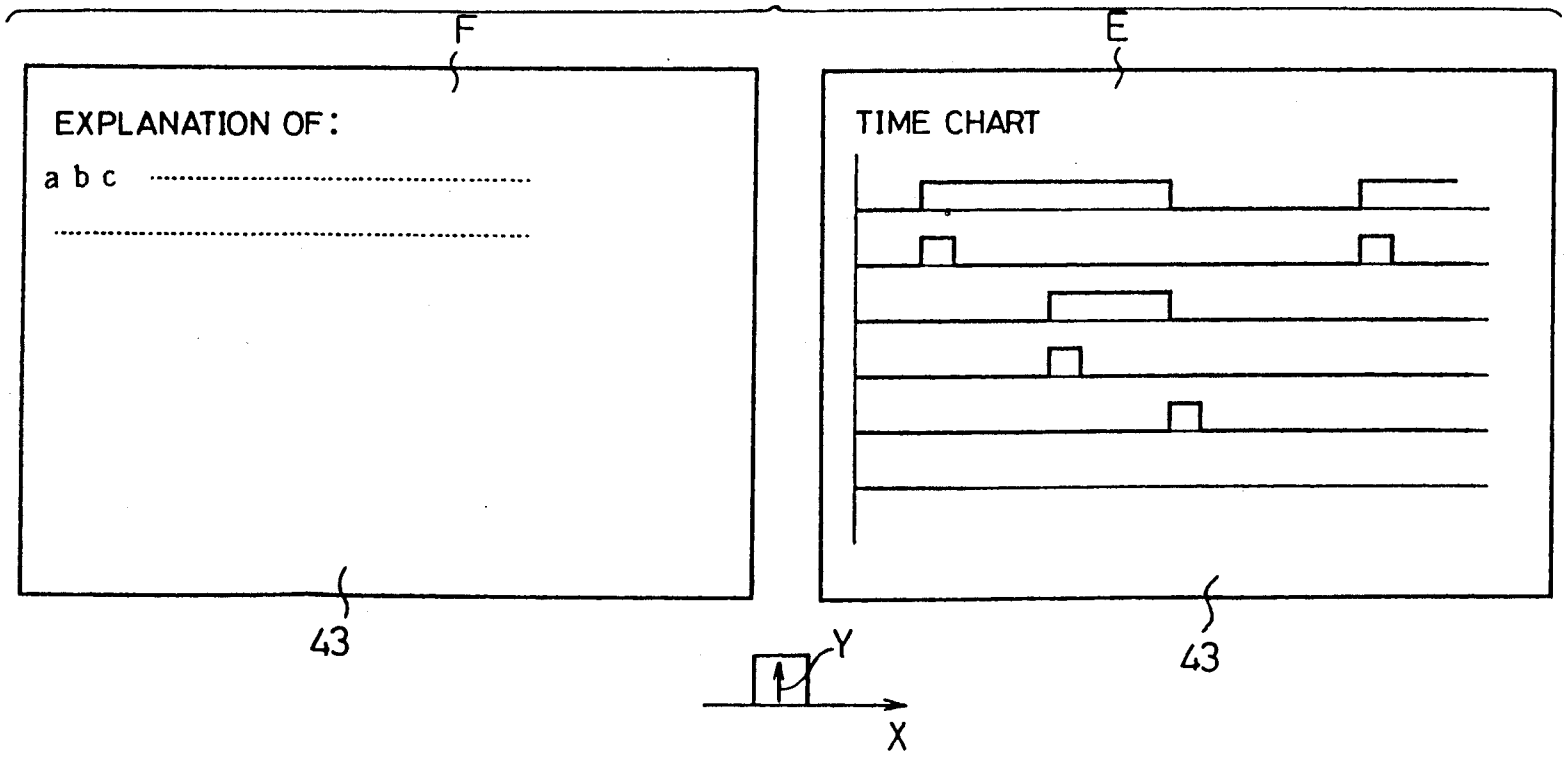
Figure 10:
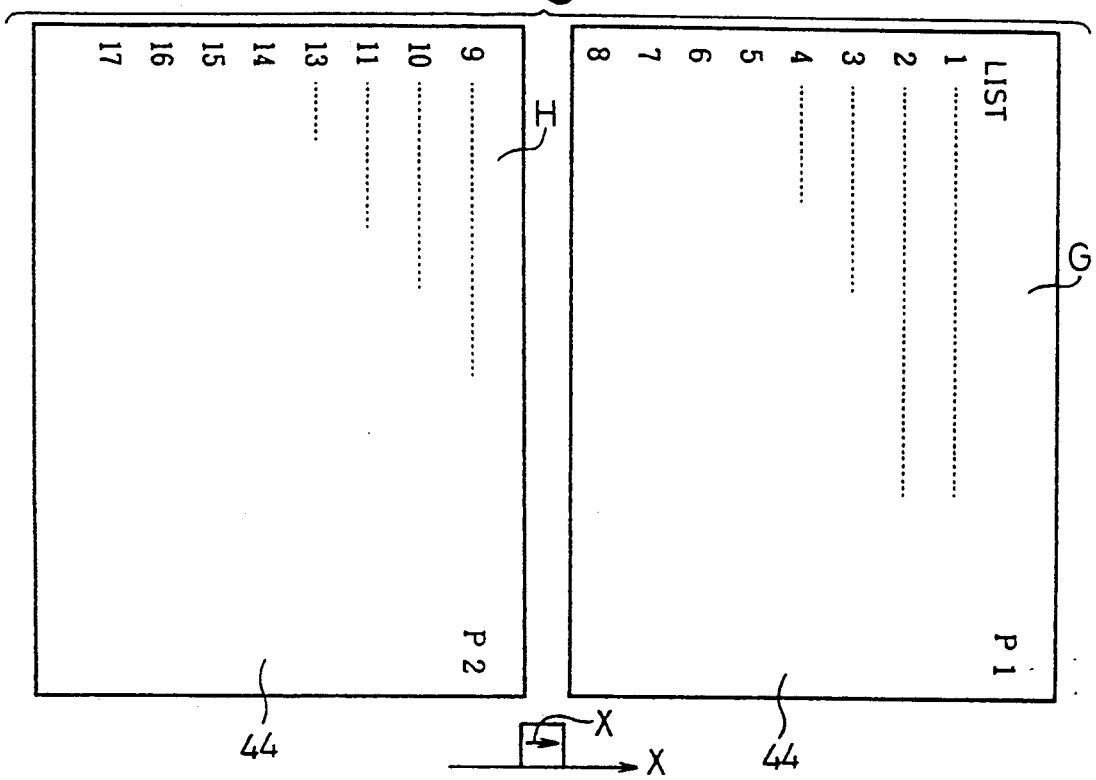
Figure 11:
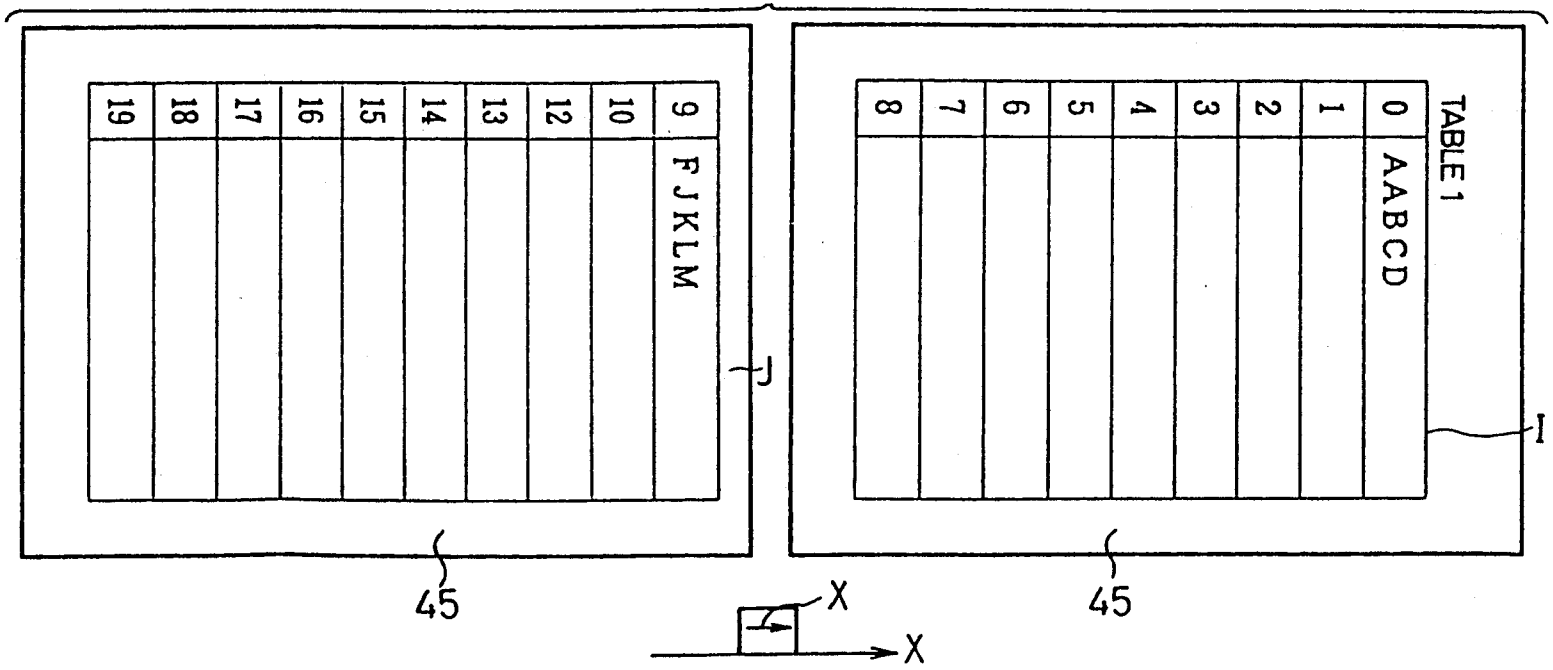

In the case of the images E and F shown in the FIG. 5, when a sheet 43 is longitudinally fed and both sides printing is performed with the printing direction Y, the image F can be formed on the surface of the next sheet 43 assuming that the image F is formed on the reverse side of the preceding sheet 43 as shown in the FIG. 9. Accordingly, even if the sheets 43, 43 are bound laterally as shown in the FIG. 5, the images E and F stand side by side in the same direction when they are spread.

In the case of the images G and H shown in the FIG. 6, when a sheet 44 is laterally fed and both sides printing is performed with the printing direction X the same as the paper feed direction, the image H can be formed on the surface of the next sheet 44 assuming that the image G is formed on the reverse side of the preceding sheet 44. Accordingly, even if the sheets 44, 44 are bound longitudinally as shown in the FIG. 6, the images G and H stand side by side in the same direction when they are spread.

In the case of the images I and J shown in the FIG. 7, when a sheet 45 is longitudinally fed and both sides printing is performed with the printing direction X, the image J can be formed on the surface of the next sheet 45 assuming that the image I is formed on the reverse side of the preceding sheet 45. Accordingly, even if the sheets 45, 45 are bound longitudinally as shown in the FIG. 7, the images I and J stand side by side in the same direction when they are spread.

As it is clear from the above description, the images which are formed by various combinations of printing direction and binding direction can be obtained. By feeding the sheets, in this embodiment the same size of JIS Standard A4 size sheet are used, either in lateral or longitudinal direction with two of the printing directions of X and Y, in other words, with two ways of printing by using rotational angles of font data 90 and 0 in the image forming controller 31, the images which are formed by various combinations of printing direction and binding direction can be obtained. Various cases of combinations are shown in a table below.

| Print Layout Binding Method | Paper Feed Direction | Font Data Rotational Angle (Both front and reverse sides) |
|---|---|---|
| Longitudinal Image Lateral | A4 Lateral | 90° |
| Lateral Image Lateral | A4 Longitudinal | 90° |
| Lateral Image Longitudinal | A4 Lateral | 0° |
| Longitudinal Image Longitudinal | A4 Longitudinal | 0° |

In order to accomplish the both sides printing shown above, A4 size sheets are set, for instance, in the upper cassette 3*a* of the image forming apparatus shown in the FIG. 1 for lateral feed, and another A4 size sheets are set in the middle cassette 3*b* for longitudinal feed. These sheets are then fed by proper selection of the paper feed cassettes for transfer process. When there is not a sheet set for the direction required by a combination of the direction or placement of an image and the binding direction, the printing as shown above can not be accomplished.

In such a case, it may be arranged to give a warning to an operator to set a sheet required. However, there occurs a time-lag in image forming process since it takes time for the operator to set a required sheet for starting again the printing. In order to solve the problem, the present invention is arranged to specially control the order of font rotational angles and the printing process by the controller 31 so that image can be formed corresponding to a predetermined direction or placement, or a binding direction by substituting a sheet which is set for a direction other than the selected direction only when a sheet selected is not set. However, it takes time for making such a control, and moreover, extra manufacturing cost is required. Such arrangement may therefore be omitted.

In the FIGS. 12 through 19, there are shown various cases when images are formed on both sides of a sheet by the special control as described above.

Figures 12, 13:
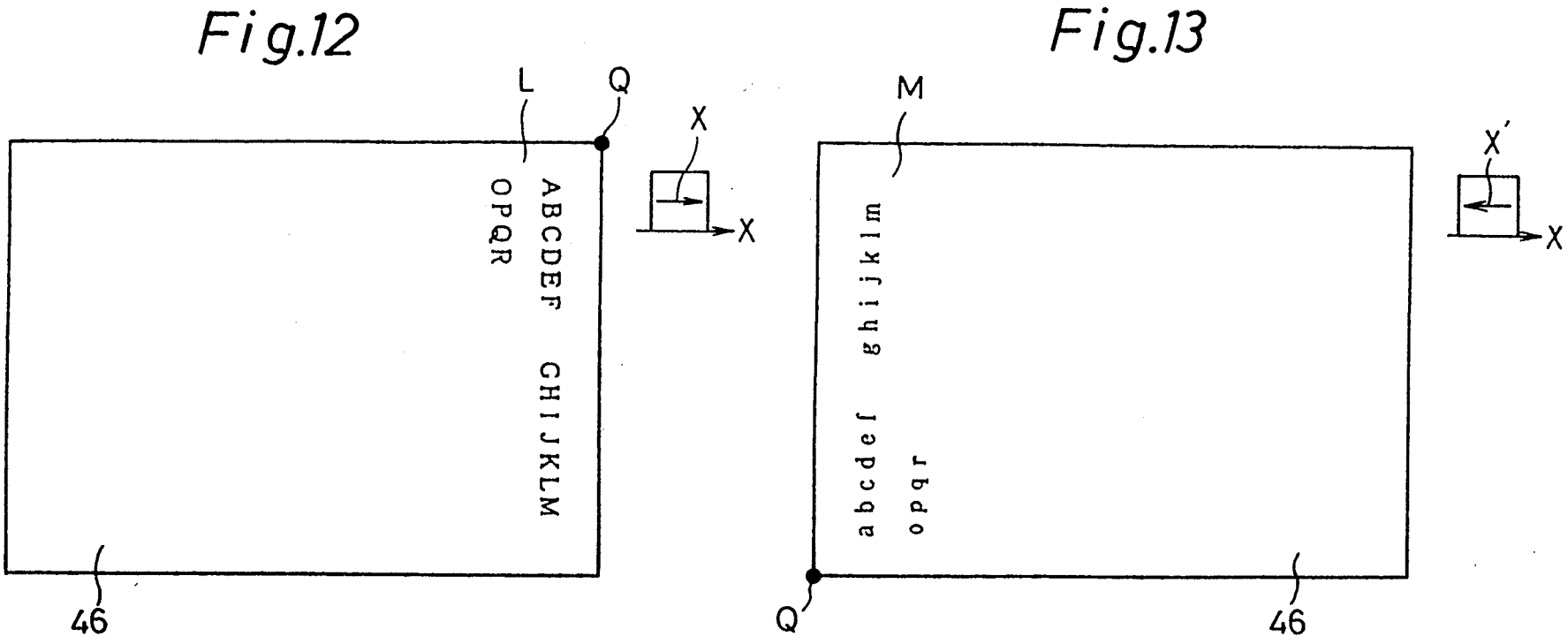
FIGS. 12 through 19 are front views showing different modes of printing on a first side and second side of a sheet when a sheet which is set for a direction other than a specified direction is substituted.

The FIGS. 12 and 13 show a case when longitudinal images L and M are formed on both sides of an A4 size longitudinal sheet 46 in place of an A4 size lateral sheet. As illustrated in the FIG. 12, the printing on a first side of a sheet is made by font data rotational angle 0° (the printing direction is also X relative to the paper feed direction X), and the basic point Q of the printing with respect to the sheet is a standard point (the printing order becomes regular in a rightward printing from the front end in the sheet transporting direction). For the printing on a second side of the sheet, the font data rotational angle is 180° as illustrated in the FIG. 13 (the printing direction becomes reverse X' relative to the paper feed direction X), and the printing basic point Q is shifted 180° from the standard point shown in the FIG. 12 (accordingly, the printing order becomes reverse in a rightward printing from the front end in the sheet feed direction).

Figure 15:
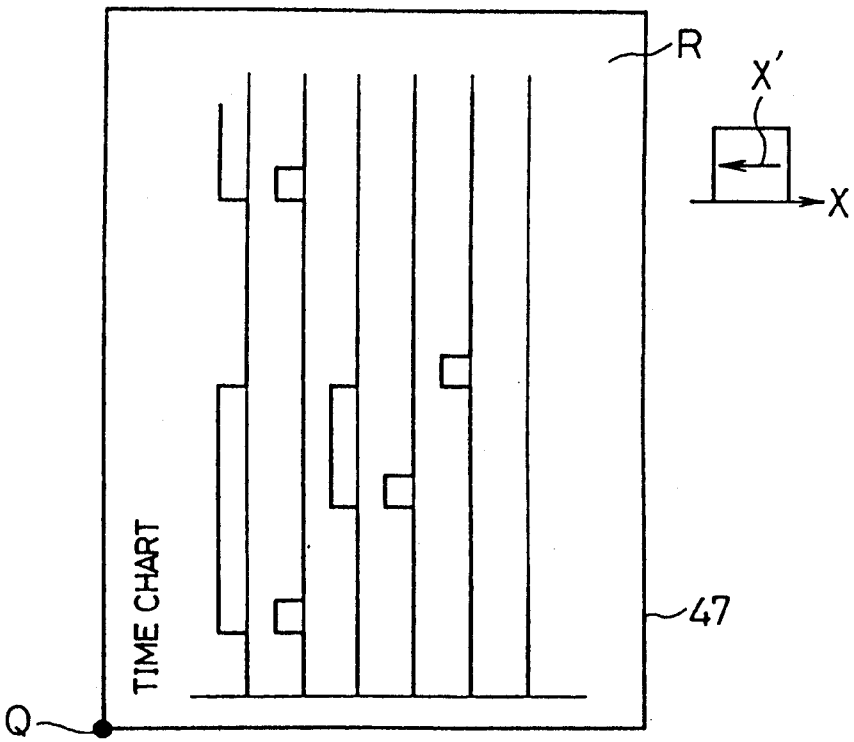
Figure 14:
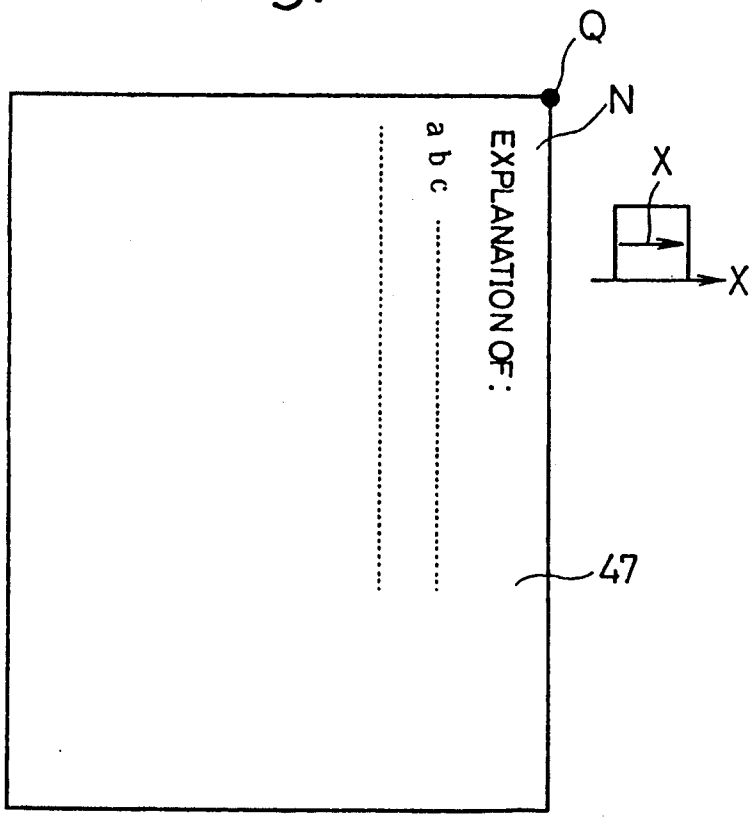

The FIGS. 14 and 15 show a case when lateral images N and R which are to be bound laterally are formed on both sides of an A4 lateral sheet 47 in place of an A4 longitudinal sheet. As shown in the FIG. 14, the printing is made on a first side of the sheet by font data rotational angle 0°, and the basic point for printing Q is the standard point. The printing on a second side of the sheet is made by font data rotational angle 180° as shown in the FIG. 5, and the printing basic point Q is shifted 180°.

Figure 17:
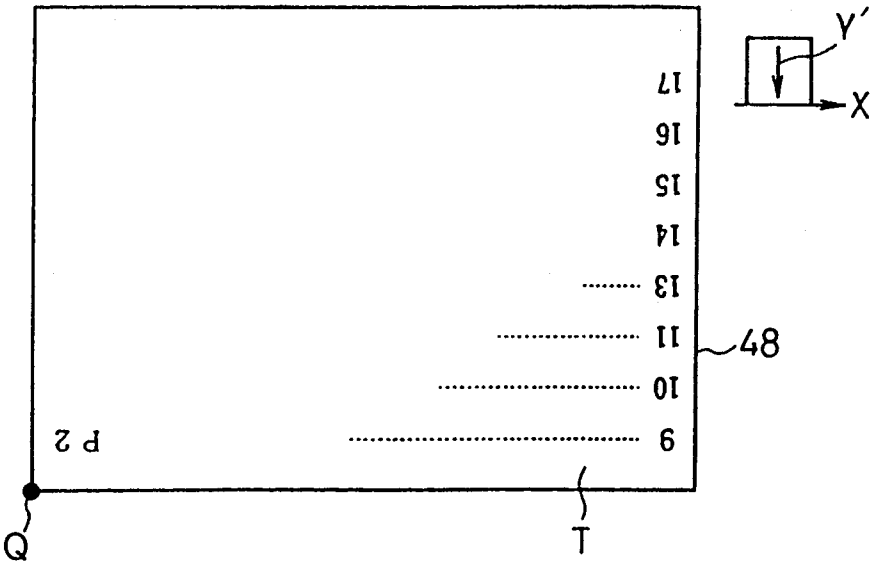
Figure 16:
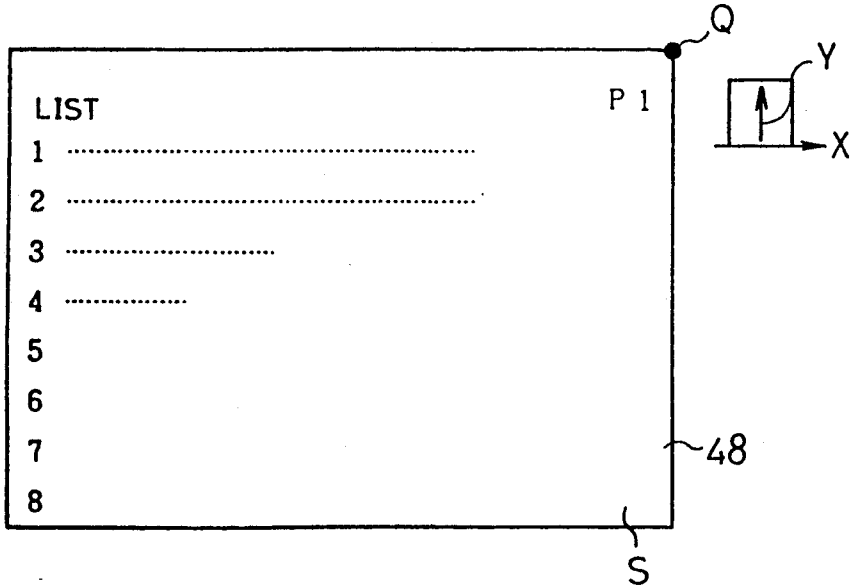

The FIGS. 16 and 17 show a case when lateral images S and T which are to be bound longitudinally are formed on both sides of an A4 longitudinal sheet 48 in place of an A4 lateral sheet. The printing on a first side of the sheet is made by font data rotational angle 90° as shown in the FIG. 16 (the printing direction becomes Y relative to the sheet feed direction X), and the basic point for printing Q is the standard point. The printing on a second side of the sheet is made by font data rotational angle 270° as illustrated in the FIG. 17 (it is a reverse of Y' direction compared with the case shown in the FIG. 16), and the basic point for printing Q is shifted 180°.

Figure 19:
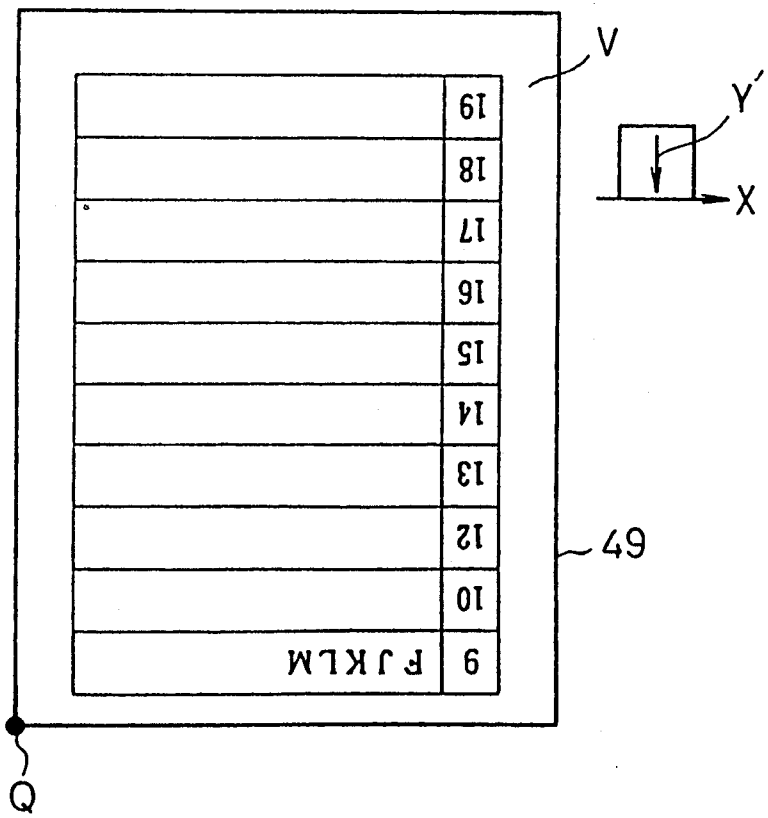
Figure 18:
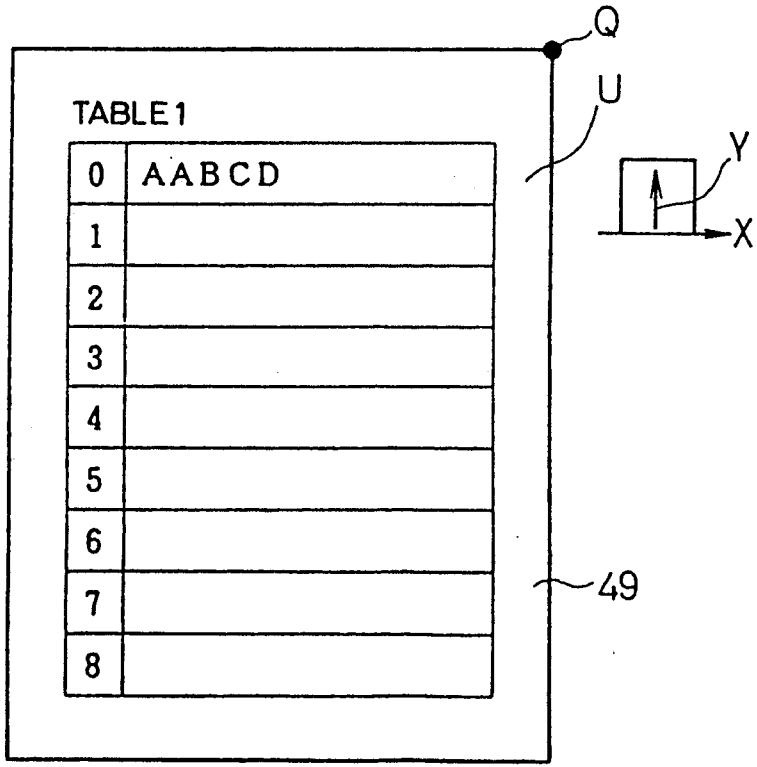

FIGS. 18 and 19 show a case when longitudinal images U and V which are to be bound longitudinally are formed on both sides of an A4 lateral sheet 49 in place of an A4 longitudinal sheet. The printing on a first side of a sheet is made by font data rotational angle 90° and the printing basic point is the standard point as illustrated in the FIG. 18. The printing on a second side of the sheet is made by font data rotational angle 270° and the printing basic point is shifted 180°.

Description will now be made on how it is controlled when both sides printing is performed referring to the FIGS. 20 through 22.

Figure 20:
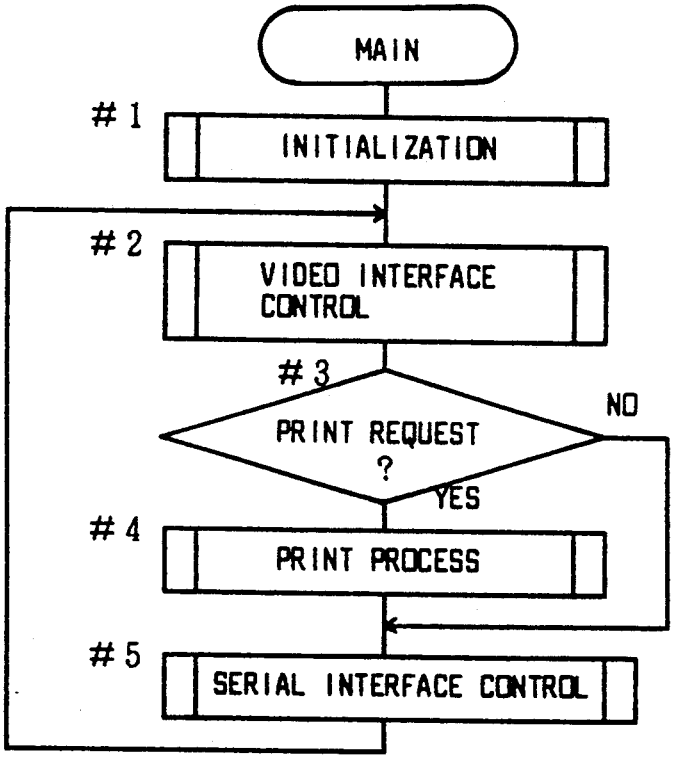
FIG. 20 is a flowchart showing a main routine of operational control of an interface control processor.

The FIG. 20 is a flowchart showing the main routine of control operation of the interface control processor 32.

Initialization is first made (step #1) to enter into a series of loops, by which the video interface 36 is controlled, and the demand from the image forming controller 31 and the signal showing the state of engine are checked (step #2). Whether there is a print requirement or not is then checked (step #3), and if there is a print requirement, print process is conducted (step #4). If there is not a print requirement, the program moves to the next step #5 to perform the serial interface control, and forms a series of loops.

Figure 21:
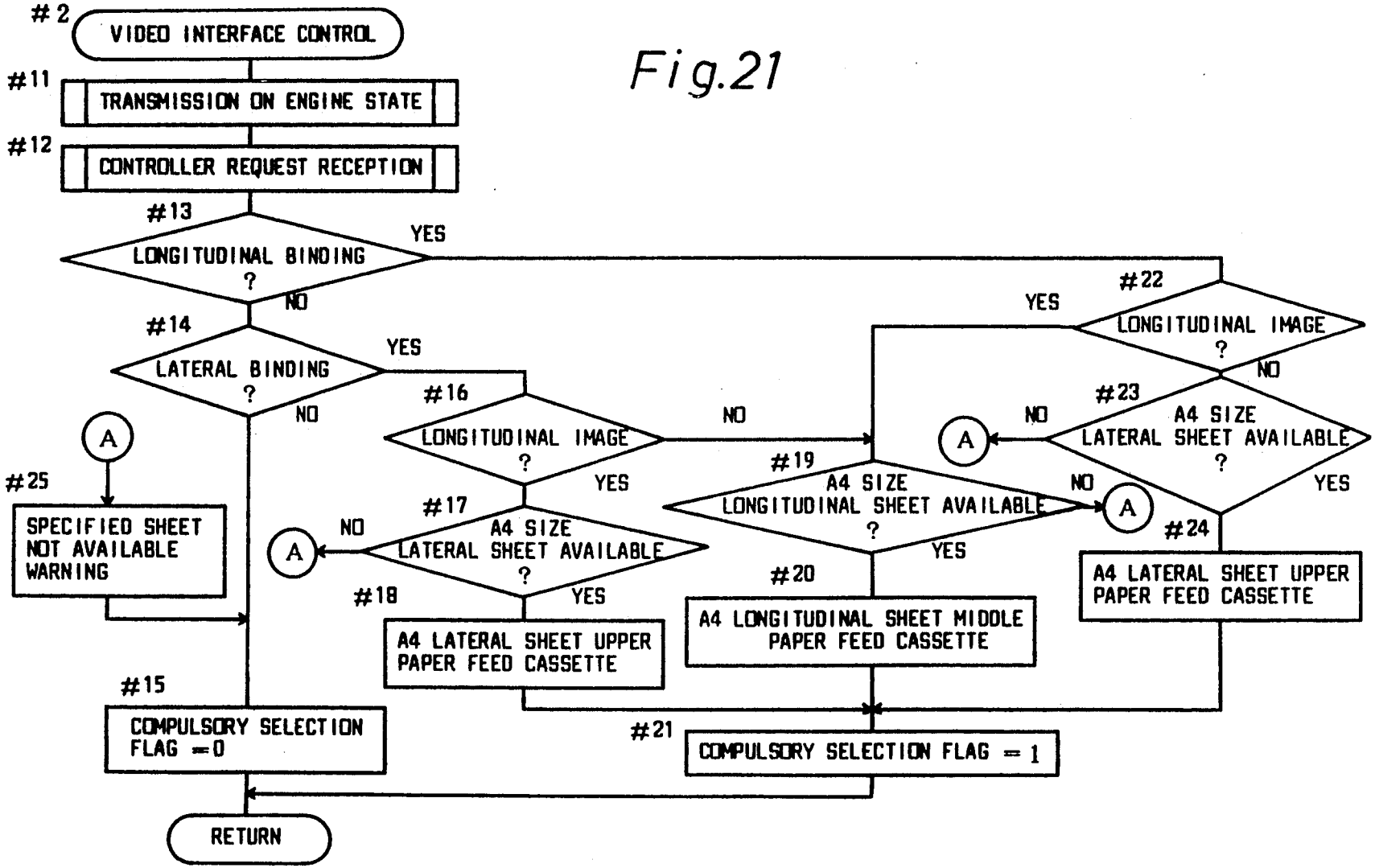
FIG. 21 is a flowchart showing a video interface control subroutine.

The FIG. 21 shows a flowchart of a control subroutine of the video interface 36. It is roughly divided into two portions of step #11 where the state of engine is transmitted and step #12 where the demand of the controller is received. The portions related to the figure are shown from steps #13 through #25.

Judgment is first made whether the demand of the controller is for longitudinal binding in the longitudinal direction or for lateral binding in the lateral direction (steps #13, 14). If there is not any one of the requirement, the program proceeds to step #15 to reset a compulsory selection flag at "0" for compulsorily selecting either one of the paper feed cassette 3*a* or 3*b*, and the program is returned. In this case, the selection is a normal selection.

When lateral binding is requested at step #14, the program proceeds to step #16 to judge whether the direction or placement of image is longitudinal or not. If the requirement is for the longitudinal image, the program moves to step #17 and judgment is made whether A4 size lateral sheet is accommodated in the apparatus or not. If the sheet is not accommodated therein, the program proceeds to step #18, and a cassette which accommodates A4 size lateral sheet is selected (in this case, for instance, the upper paper feed cassette is selected.)

If the judgment at step #16 is made that the requested image is not longitudinal, judgment is made whether or not A4 size longitudinal sheet is accommodated in the apparatus or not at step #19. If the sheet is accommodated, a cassette which accommodates A4 size longitudinal sheet is selected (in this case, for instance, the middle paper feed cassette is selected). In either one of the cases described above, the paper feed cassettes are compulsorily selected, and therefore, the compulsory selection flag is set at "1" at step #21 and the program is returned.

When longitudinal binding is requested at step #13, the program moves to step #22 to judge whether or not the direction or placement of image is longitudinal. If the longitudinal image is requested, judgment is made at step #19 whether or not A4 size longitudinal sheet is accommodated in the apparatus. If the sheet is accommodated, the A4 size longitudinal sheet is selected at step #20.

If it is judged that the image is not longitudinal at step #22, judgment is made whether A4 size lateral sheet is accommodated or not at step #23, and if the A4 size lateral sheet is accommodated, the A4 size lateral sheet is selected at step #24. In either one of the cases, the compulsory flag is set at "1" at step #21, and the program is returned.

When it is found that there is not accommodated a sheet which is specified its size and direction at steps #17, #19 and #23, a warning is given at step #25 by activating a buzzer 101 shown in the FIG. 1 or switching on an unillustrated warning indicator, and the compulsory flag is set at "0" at step #15, and the program is returned. In this case, a warning is given to the image forming controller 31 at step #2 (FIG. 4) and a substitute sheet which is different in size and direction from the sheet compulsorily selected is fed making reference to a cassette selection made by an ordinary interface, and the controller performs a printing process for the sheet substituted.

Figure 22:
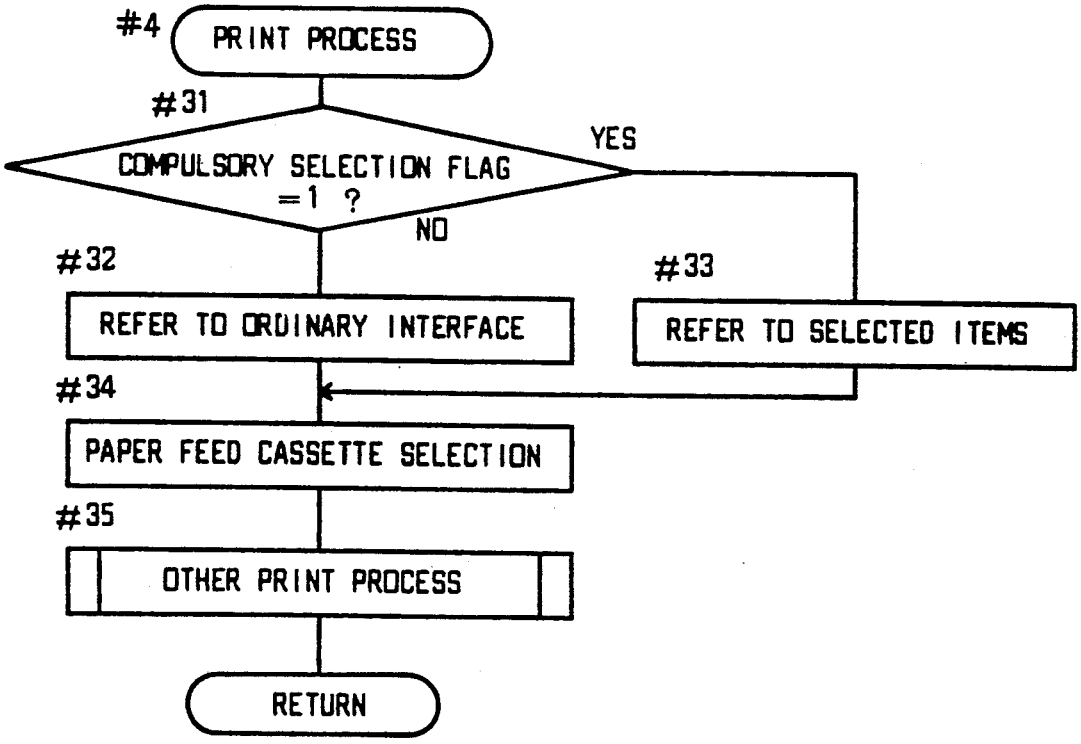
FIG. 22 is a flowchart showing a print process subroutine.

The FIG. 22 shows a flowchart of print process subroutine. The basic print process is conducted at step #35, and concrete description is omitted.

Judgment is first made whether the compulsory flag is set at "1" or not, and if it is not "1", reference is made to the cassette selection made by an ordinary interface (step #32). If the compulsory flag is set at "1", reference is made to the items preliminarily selected at steps #18, #20 and #24 in the video interface control subroutine (step #33). In accordance with the contents of the reference, paper feed cassette is selected (step #34), and other print process is conducted.

The selection of paper feed cassettes can thus be changed for an ordinary selection or for a compulsory selection which corresponds to a combination of the print layout and the binding direction.

In the above embodiment, description has been made only on an example of the relationship between the print layout and the binding method, and the combination of printing rotational angles to be used. The present invention is not limited to the description made above, and various combinations may be adopted.

The warning may be given visually by LED or the like, or aurally by buzzer or the like.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for forming images on both sides of a sheet comprising:

a paper feed means for feeding a sheet which is capable of feeding the sheet laterally and longitudinally relative to a sheet transporting direction;

means for forming an image on the sheet which is capable of forming a longitudinal image parallel to and perpendicular to the sheet transporting direction; and a control means for selecting the sheet feed direction which selects a direction of the sheet supplied by the paper feed means corresponding to the placement of images to be formed on the both sides of the sheet.

2. An image forming apparatus as defined in claim 1, wherein the image forming means changes a direction of image formation relative to the sheet transporting direction by rotation of font data.

3. An image forming apparatus as defined in claim 1, wherein the control means controls the direction of image formation which controls the image forming means so as to form images on the both sides of the sheet in the same direction relative to the sheet transporting direction.

4. An image forming apparatus as defined in claim 1, wherein the paper feed means includes a plurality of sheet accommodating sections for separately accommodating the sheets of same size in different directions, laterally and longitudinally, and the control means selects a direction of the sheet supplied by selectively using the sheet accommodating sections.

5. An image forming apparatus as defined in claim 4, further includes a means for giving a warning which sends out the warning when the sheet selected by the control means is not accommodated in the sheet accommodating section.

6. An image forming apparatus as defined in claim 1, wherein the paper feed means includes a plurality of sheet accommodating sections for separately accommodating sheets of the same size in different directions, laterally and longitudinally, and the first control means selects a direction of the sheet supplied by selectively using the sheet accommodating sections.

7. An image forming apparatus as defined in claim 6, further including a means for giving a warning which sends out the warning when the sheet selected by the first control means is not accommodated in the sheet accommodating section and a substitute sheet is selected.

8. An image forming apparatus for forming images on both sides of a sheet comprising:

a paper feed means for feeding a sheet which is capable of feeding the sheet laterally and longitudinally relative to the sheet transporting direction;

means for forming an image on the sheet which is capable of forming a longitudinal image parallel to and perpendicular to the sheet transporting direction;

a first control means for selecting a sheet feed direction which selects a direction of the sheet supplied by the sheet feed means corresponding to the placement of images to be formed on the both sides of the sheet, and also selects a substitute sheet when the sheet selected is not set; and a second control means for controlling a direction of images to be formed which controls a direction of images to be formed on the both sides of the sheet corresponding to a direction of the sheet when a substitute sheet is selected by the first control means.

9. An image forming apparatus as defined in claim 8, wherein the image forming means changes a direction of image formation relative to the sheet transporting direction by rotation of font data.

10. An image forming apparatus as defined in claim 8, wherein the second control means controls the image forming means so as to form images on the both sides of the sheet in the same direction relative to the sheet transporting direction.

11. An image forming apparatus as defined in claim 8, wherein the paper feed means includes a plurality of sheet accommodating sections for separately accommodating sheets of the same size in different directions, laterally and longitudinally, and the first control means selects a direction of the sheet supplied by selectively using the sheet accommodating sections.

12. An image forming apparatus as defined in claim 11, further includes a means for giving a warning which sends out the warning when the sheet selected by the first control means is not accommodated in the sheet accommodating section and a substitute sheet is selected.

13. An image forming apparatus for forming images on both sides of a sheet comprising:

a paper feed means for feeding a sheet laterally and longitudinally relative to a sheet transporting direction;

storing means for storing two sets of fonts in the lateral and longitudinal directions relative to a sheet transporting direction;

image forming means for forming a longitudinal image parallel to and perpendicular to the sheet transporting direction by using the fonts stored in the storing means; and control means for controlling a direction of an image to be formed by the image forming means and a direction of a sheet to be fed by the paper feed means so as to form images on first and second sides of the sheet by using a font in the same direction when images are formed on a first side and a second side which is the reverse side of the sheet.

* * * * *